US010974500B2

(12) United States Patent
Nishio

(10) Patent No.: US 10,974,500 B2
(45) Date of Patent: Apr. 13, 2021

(54) PRINTING DEVICE AND CONTROL METHOD FOR PRINTING DEVICE

(71) Applicant: SEIKO EPSON CORPORATION, Tokyo (JP)

(72) Inventor: Satoru Nishio, Sapporo (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/688,715

(22) Filed: Nov. 19, 2019

(65) Prior Publication Data

US 2020/0156367 A1 May 21, 2020

(30) Foreign Application Priority Data

Nov. 21, 2018 (JP) ..... JP2018-218599

(51) Int. Cl.

| | |
|---|---|
| ***B41J 29/393*** | (2006.01) |
| ***B41J 2/045*** | (2006.01) |
| ***B41J 11/00*** | (2006.01) |
| ***B41J 29/38*** | (2006.01) |
| ***B41J 2/165*** | (2006.01) |
| ***B41J 11/70*** | (2006.01) |

(52) U.S. Cl.

CPC ..... *B41J 2/0451* (2013.01); *B41J 2/16532* (2013.01); *B41J 11/002* (2013.01); *B41J 11/007* (2013.01); *B41J 11/70* (2013.01); *B41J 29/38* (2013.01); *B41J 2002/16573* (2013.01)

(58) Field of Classification Search

None

See application file for complete search history.

(56) References Cited

U.S. PATENT DOCUMENTS 5,493,415 A * 2/1996 Mita ..... G06T 1/20 358/444
2008/0314316 A1* 12/2008 Kitabata ..... G05B 23/0224 118/712
2012/0013660 A1* 1/2012 Mano ..... B41J 2/16508 347/9
2015/0314618 A1* 11/2015 Ohashi ..... B41J 11/70 347/16

FOREIGN PATENT DOCUMENTS

JP 2001-356616 12/2001

* cited by examiner

*Primary Examiner* — Erica S Lin
*Assistant Examiner* — Tracey M McMillion
(74) *Attorney, Agent, or Firm* — Workman Nydegger

(57) ABSTRACT

A printing device includes a printing section including an inkjet head configured to eject ink onto a conveyed roll paper, a conveying section configured to convey the conveyed roll paper, and a control section configured to print an image on the conveyed roll paper with the printing section and the conveying section. The control section has a normal printing mode for printing the image with a plurality of operations based on the printing section and the conveying section and a high-speed printing mode for, during first print, printing the image while omitting or changing a part of the plurality of operations included in the normal printing mode according to the operation.

7 Claims, 5 Drawing Sheets

PRINTING DEVICE AND CONTROL METHOD FOR PRINTING DEVICE

The present application is based on, and claims priority from JP Application Serial Number 2018-218599, filed Nov. 21, 2018, the disclosure of which is hereby incorporated by reference herein in its entirety.

BACKGROUND

1. Technical Field

The present disclosure relates to a printing device and a control method for the printing device.

2. Related Art

There has been known a device that performs first printing after acquisition of a printing request at high speed. For example, JP A-2001-356616 (Patent Literature 1) discloses a device that, when performing printing of a small number of prints, reduces a warmup time of a drying mechanism to increase the speed of first printing after acquisition of a printing request.

However, concerning the increase in the speed of the first printing after the acquisition of the printing request, Patent Literature 1 does not consider operations other than a warmup operation of the drying mechanism. Therefore, there is room of achieving a further increase in the speed.

SUMMARY

An aspect of the present disclosure is directed to a printing device including: a printing section including a printing head configured to eject ink onto a printing medium; a conveying section configured to convey the printing medium; and a control section configured to print an image on the printing medium with the printing section and the conveying section. The control section has a first printing mode for printing the image with a plurality of operations based on the printing section and the conveying section and a second printing mode for, during first printing after acquisition of a printing request, printing the image while omitting or changing a part of the plurality of operations included in the first printing mode according to the operation.

In the printing device, the plurality of operations may include a maintenance operation for maintaining the printing head, and the control section may omit the maintenance operation in the second printing mode.

In the printing device, the plurality of operations may include a micro-weave printing operation for performing printing in a micro-weave printing scheme with the printing section, and the control section may omit, in the second printing mode, the micro-weave printing operation for an end portion of the image in a conveying direction of the printing medium.

In the printing device, the printing section may include a cutting section configured to cut the printing medium, the plurality of operations may include a cutting operation for cutting the printing medium with the cutting section, and the control section may change, in the second printing mode, the cutting operation such that a number of times of cutting in the cutting operation is smaller than the number of times of cutting during the first printing mode.

In the printing device, the control section may change the number of times of cutting at an end portion on an upstream of the conveying direction of the printing medium among end portions of the image.

In the printing device, the printing section may include a cutting section configured to cut the printing medium, the plurality of operations may include a cutting operation for cutting the printing medium with the cutting section, and, when not continuously printing a plurality of the images in the second printing mode, the control section may change the cutting operation to cut the printing medium without decelerating the conveyance of the printing medium in the cutting operation.

In the printing device, the printing section may include a heating section configured to heat the printing medium, the plurality of operations may include a standby operation for putting printing of the image on standby until a heating temperature of the heating section stabilizes, and the control section may omit the standby operation when not continuously printing a plurality of the images in the second printing mode.

Another aspect of the present disclosure is directed to a control method for a printing device including: a printing section including a printing head configured to eject ink onto a printing medium; a conveying section configured to convey the printing medium; and a control section configured to print an image on the printing medium with the printing section and the conveying section. The control section prints, in a first printing mode, the image with a plurality of operations based on the printing section and the conveying section and prints, in the second printing mode, during first printing after acquisition of a printing request, the image while omitting or changing a part of the plurality of operations included in the first printing mode according to the operation.

DESCRIPTION OF EXEMPLARY EMBODIMENTS

Figure 1:
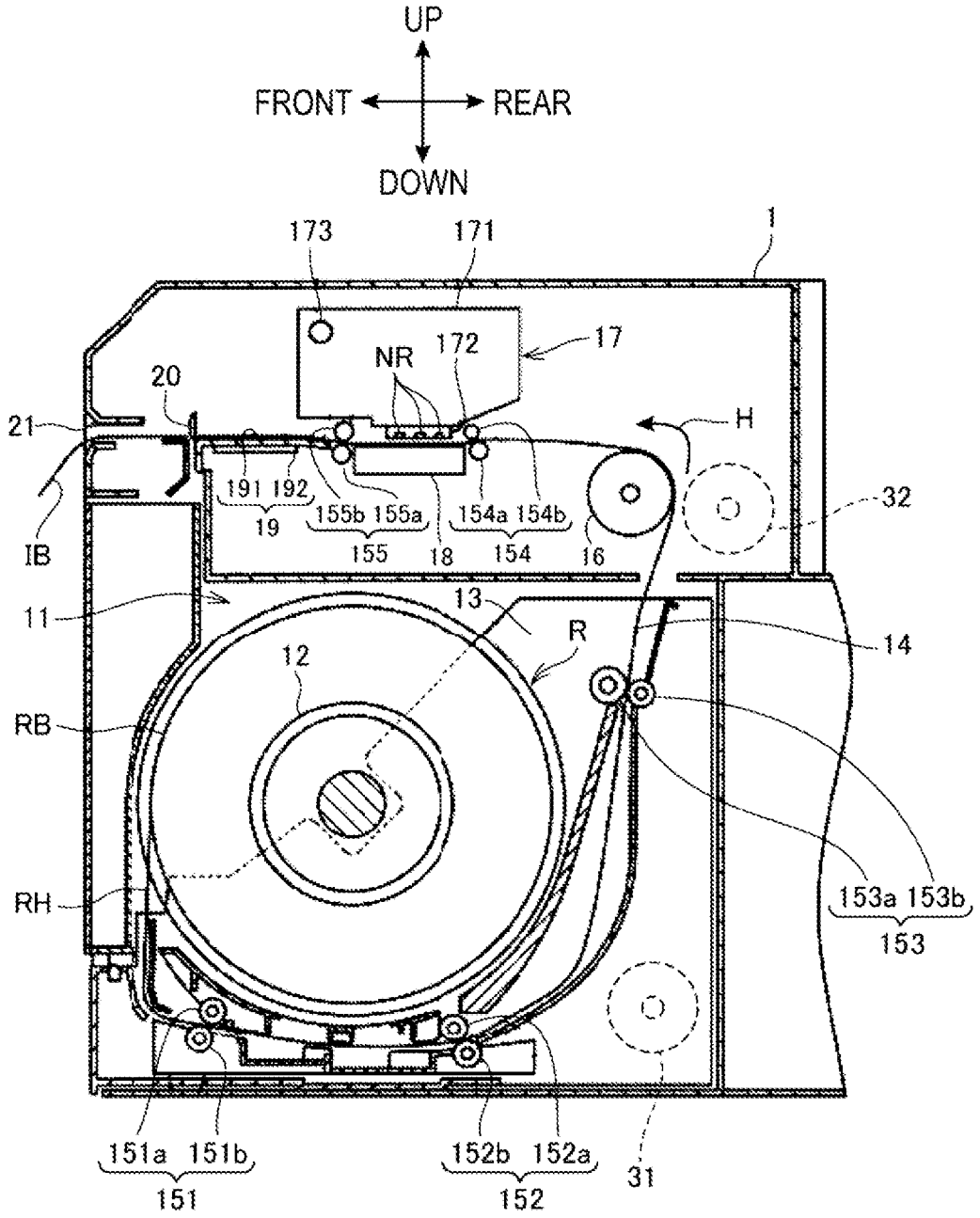
FIG. 1 is a diagram showing the configuration of a main part of a printing device.

FIG. 1 is a diagram showing the configuration of a main part of a printing device 1.

In explanation referring to FIG. 1, as indicated by arrows, a leftward direction in the figure is represented as "front", a rightward direction in the figure is represented as "rear", an upward direction in the figure is represented as "upward", and a downward direction in the figure is represented as "downward".

A printing device 1 is a serial inkjet printer. The printing device 1 stores roll paper R, which is a roll-like sheet, lets out the roll paper R, and conveys the roll paper R in a conveying direction H. The roll paper R corresponds to an example of a printing medium. The printing device 1 ejects ink onto the conveyed roll paper R with an inkjet head 172 configured as a serial head and performs printing. The inkjet head 172 corresponds to an example of a printing head.

As shown in FIG. 1, the printing device 1 includes a roll-paper storing section 11 that stores the roll paper R. In the following explanation, in the roll paper R, a roll-like portion stored in the roll-paper storing section 11 is referred to as "roll body" and denoted by a reference sign "RB". In the roll paper R, a portion let out from the roll body RB stored in the roll-paper storing section 11 and conveyed is referred to as "conveyed roll paper" and denoted by a reference sign "RH". The roll body RB and the conveyed roll paper RH correspond to an example of a printing medium.

As shown in FIG. 1, the roll-paper storing section 11 includes a roll-body supporting section 12 that rotatably supports the roll body RB and a pair of support walls 13 that supports the roll-body supporting section 12. The roll-body supporting section 12 is coupled to a motor shaft of a first conveyance motor 31 via a not-shown power transmission mechanism. The roll-body supporting section 12 rotates according to driving of the first conveyance motor 31. The roll body RB rotates in association with the rotation of the roll-body supporting section 12. The conveyed roll paper RH is let out from the roll body RB.

As shown in FIG. 1, a conveying path 14, which is a path on which the conveyed roll paper RH is conveyed, is formed in the printing device 1. The conveyed roll paper RH let out from the roll body RB is conveyed in the conveying direction H along the conveying path 14.

In the conveying path 14, five conveying roller pairs 151, 152, 153, 154, and 155 are provided from upstream to downstream in the conveying direction H. An intermediate roller 16 is provided between the conveying roller pairs 153 and 154 in the conveying path 14.

The conveying roller pair 151 includes a conveying roller 151*a* that rotates according to the driving of the first conveyance motor 31 and a driven roller 151*b* that rotates following the rotation of the conveying roller 151*a*. The conveying roller 151*a* and the driven roller 151*b* hold the conveyed roll paper RH.

The conveying roller pair 152 includes a conveying roller 152*a* similar to the conveying roller 151*a* and a driven roller 152*b* similar to the driven roller 151*b*. The conveying roller 152*a* and the driven roller 152*b* hold the conveyed roll paper RH.

The conveying roller pair 153 is provided further downstream than the conveying roller pairs 151 and 152 in the conveying direction H. The conveying roller pair 153 includes a conveying roller 153*a* that rotates according to driving of a second conveyance motor 32 and a driven roller 153*b* that rotates following the rotation of the conveying roller 153*a*. The conveying roller 153*a* and the driven roller 153*b* hold the conveyed roll paper RH.

The intermediate roller 16 is provided further downstream than the conveying roller pair 153 in the conveying direction H. The intermediate roller 16 is a roller that rotates according to the driving of the second conveyance motor 32. The diameter of the intermediate roller 16 is set larger than the diameter of rollers of the conveying roller pairs 151, 152, 153, 154, and 155. The intermediate roller 16 may be configured by a roller that rotates following the conveyance of the conveyed roll paper RH.

The conveying roller pair 154 is provided further downstream than the intermediate roller 16 in the conveying direction H and further upstream than the inkjet head 172 in the conveying direction H. The conveying roller pair 154 includes a conveying roller 154*a* that rotates according to the driving of the second conveyance motor 32 and a driven roller 154*b* that rotates following the rotation of the conveying roller 154*a*. The conveying roller 154*a* and the driven roller 154*b* hold the conveyed roll paper RH. The conveying roller 154*a* is configured by, for example, a SMAP roller in which a roller section in contact with the conveyed roll paper RH and a driving shaft are integrally formed.

The conveying roller pair 155 is provided further downstream than the inkjet head 172 in the conveying direction H. The conveying roller pair 155 includes a conveying roller 155*a* that rotates according to the driving of the second conveyance motor 32 and a driven roller 155*b* that rotates following the rotation of the conveying roller 155*a*. The conveying roller 155*a* and the driven roller 155*b* hold the conveyed roll paper RH.

As shown in FIG. 1, a printing unit 17 is provided between the conveying roller pair 154 and the conveying roller pair 155 in the conveying path 14.

The printing unit 17 includes a carriage 171 and the inkjet head 172 mounted on the carriage 171.

The carriage 171 is supported by a carriage shaft 173 extending in a crossing direction KY crossing the conveying direction H. The carriage 171 scans the inkjet head 172 in the crossing direction KY along the carriage shaft 173. In this embodiment, the crossing direction KY is a direction orthogonal to the conveying direction H.

The inkjet head 172 includes nozzle rows NR of a plurality of colors. The inkjet head 172 includes, for example, nozzle rows NR of four colors of cyan, yellow, magenta, and black. The inkjet head 172 receives supply of ink from not-shown ink cartridges, ejects the ink from nozzles provided in the nozzle rows NR, and forms dots on the conveyed roll paper RH.

A platen 18 that supports the conveyed roll paper RH is provided in a position opposed to the inkjet head 172 between the conveying roller pairs 154 and 155 below the carriage 171.

As shown in FIG. 1, a heating unit 19 is provided downstream of the conveying roller pair 155 in the conveying direction H. The heating unit 19 corresponds to an example of a heating section. The heating unit 19 includes a heating plate 191 that transfers heat to the conveyed roll paper RH and a heater 192 that heats the heating plate 191. The heating unit 19 transfers heat of the heater 192 to the conveyed roll paper RH located on the upper surface of the heating plate 191 to heat the conveyed roll paper RH and fixes and dries the ink ejected onto the conveyed roll paper RH.

As shown in FIG. 1, a cutter 20 is provided downstream of the heating unit 19 in the conveying direction H. The cutter 20 corresponds to an example of a cutting section. The cutter 20 is configured by, for example, a fixed blade and a movable blade movable to cross the fixed blade. The cutter 20 moves the movable blade to cut the conveyed roll paper RH.

As shown in FIG. 1, a paper discharge port 21 is provided downstream of the cutter 20 in the conveying direction H. The conveyed roll paper RH cut by the cutter 20 is discharged to a housing of the printing device 1 as a print IB via the paper discharge port 21.

Figure 2:
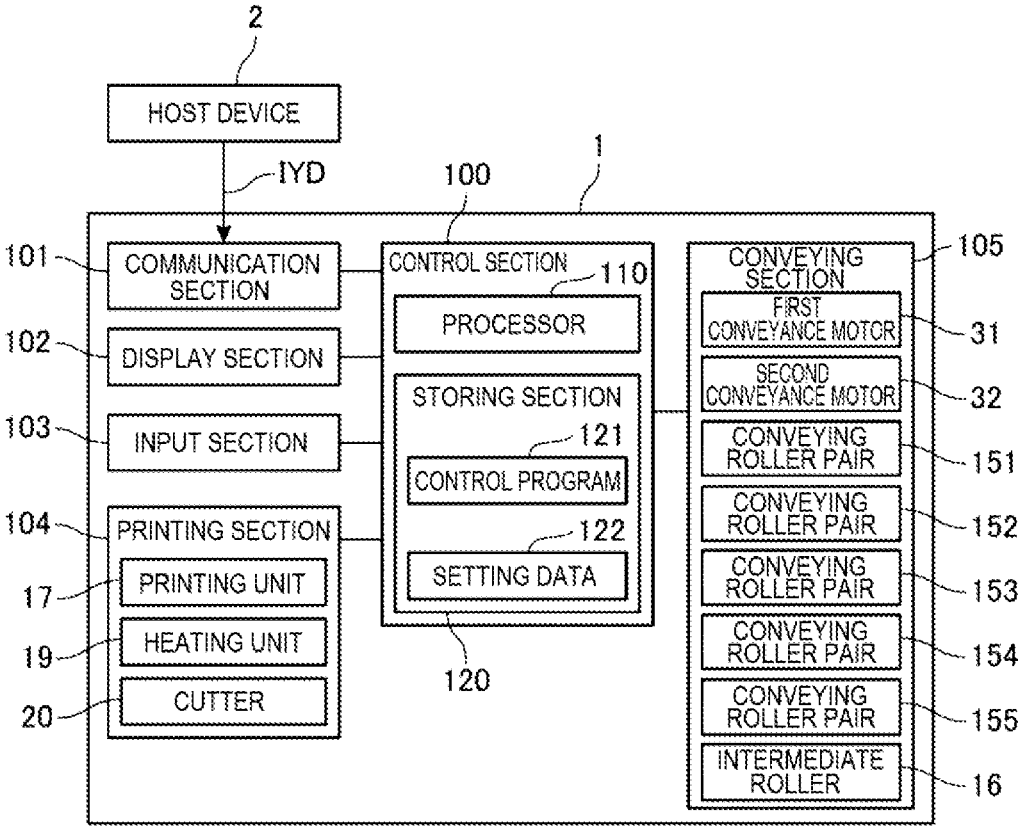
FIG. 2 is a diagram showing a functional configuration of the printing device.

FIG. 2 is a diagram showing a functional configuration of the printing device 1.

As shown in FIG. 2, the printing device 1 includes a control section 100, a communication section 101, a display section 102, an input section 103, a printing section 104, and a conveying section 105.

The control section 100 includes a processor 110 such as a CPU or an MPU that executes programs and a storing section 120 and controls the sections of the printing device 1. The control section 100 executes various kinds of processing according to cooperation of hardware and software such that the processor 110 reads out a control program 121 stored in the storing section 120 and executes processing.

The storing section 120 includes a storage region for storing the programs to be executed by the processor 110 and data processed by the processor 110. The storing section 120 stores the control program 121 to be executed by the processor 110 and setting data 122. The setting data 122 includes setting values concerning the operation of the printing device 1. The storing section 120 may store other programs and data besides the control program 121 and the setting data 122. The storing section 120 includes a nonvolatile storage region for storing programs and data in a nonvolatile manner. The storing section 120 may include a volatile storage region and configure a work area for temporarily storing the programs to be executed by the processor 110 and data to be processed by the processor 110.

The communication section 101 includes hardware necessary for communication such as a connector and an interface circuit. The communication section 101 communicates with an external device according to a predetermined communication standard under the control by the control section 100. Any communication standard can be adopted as the communication standard used by the communication section 101 in the communication with the external device. For example, both of a communication standard related to serial communication such as USB or RS232C and a communication standard related to a LAN can be adopted. The communication standard used by the communication section 101 in the communication with the external device may be a communication standard related to wireless communication or may be a communication standard related to wired communication.

In this embodiment, a host device 2 is illustrated as the external device that communicates with the printing device 1. The host device 2 is a computer operated by a user. A desktop computer, a notebook computer, a tablet computer, and the like can be used as the host device 2. A smartphone, a cellular phone, and the like can be used as the host device 2. The host device 2 communicates with the printing device 1. The host device 2 is capable of transmitting printing request data IYD explained below to the printing device 1.

The display section 102 includes a plurality of LEDs and a display panel. The display section 102 executes lighting and extinction of the LEDs in predetermined forms, display of information on the display panel, and the like under the control by the control section 100.

The input section 103 includes an operation switch provided in the housing of the printing device 1. The input section 103 detects operation on the operation switch and outputs a signal indicating the detected operation to the printing device 1. The control section 100 executes processing corresponding to the operation according to an input from the input section 103.

The printing section 104 includes mechanisms related to issuance of the print IB such as the printing unit 17, a carriage driving motor that causes the carriage 171 to scan in the crossing direction KY, a driving circuit that drives the inkjet head 172, the heating unit 19, a driving circuit that drives the heater 192, the cutter 20, and a driving circuit that drives the cutter 20. Under the control by the control section 100, the printing section 104 ejects ink onto the conveyed roll paper RH to print an image G with the printing unit 17, fixes and dries the ink ejected onto the conveyed roll paper RH with the heating unit 19, and cuts the conveyed roll paper RH with the cutter 20 to issue the print IB on which the image G is printed.

The conveying section 105 includes mechanisms related to conveyance of the conveyed roll paper RH such as the first conveyance motor 31 that rotates the conveying roller pairs 151 and 152 and the roll-body supporting section 12, the second conveyance motor 32 that rotates the conveying roller pairs 153, 154, and 155 and the intermediate roller 16, the conveying roller pairs 151, 152, 153, 154, and 155, and the intermediate roller 16. The conveying section 105 includes mechanisms such as a power transmission mechanism that transmits power of the conveyance motors to the rollers and a motor driver that drives the conveyance motors. Under the control by the control section 100, the conveying section 105 drives the conveyance motors to rotate the conveying rollers and conveys, in the conveying direction H, the conveyed roll paper RH let out from the roll body RB.

When receiving the printing request data IYD from the host device 2, during first printing after the reception of the printing request data IYD, the printing device 1 in this embodiment executes different operations when an operation mode is a normal printing mode and when the operation mode is a high-speed printing mode. The reception of the printing request data IYD is equivalent to acquisition of a printing request. The normal printing mode is equivalent to a first printing mode. The high-speed printing mode is equivalent to a second printing mode.

In the following explanation, first printing after the reception of the printing request data IYD is referred to as "first print".

The normal printing mode is an operation mode for, when the first print is performed, executing the first print without performing omission of a plurality of operations explained below and a change of operation content. In the normal printing mode in this embodiment, when the first print is performed, a maintenance operation, a heating temperature stabilization standby operation, a paper feeding operation, a micro-weave printing operation, and cutting operation are executed besides operation for conveying the conveyed roll paper RH and operation for ejecting ink from the inkjet head 172. The heating temperature stabilization standby operation corresponds to an example of a standby operation.

These operations in the normal printing mode are explained in detail below.

Maintenance Operation

First, the maintenance operation is explained.

The maintenance operation includes a nozzle check operation and a cleaning operation.

The nozzle check operation is operation for detecting whether an ejection failure occurs concerning each of nozzles NZ configuring the nozzle rows NR included in the inkjet head 172. The ejection failure is caused by an increase in the viscosity of ink stored in cavities of the nozzles NZ, mixing of air bubbles in the cavities, adhesion of foreign matters to the nozzles NZ, and the like.

The control section 100 executes the nozzle check operation, for example, according to a method explained below.

In the cavities of the nozzles NZ, vibration plates that cause the capacities of the cavities to fluctuate and eject the ink stored in the cavities from the nozzles NZ are provided and actuators that vibrate the vibration plates are provided. The control section 100 has a function of detecting, as a waveform, residual vibration of the vibration plates at the time when the ink is ejected from the nozzles NZ. In the nozzle check operation, the control section 100 causes each of the nozzles NZ to sequentially eject a predetermined amount of the ink. The control section 100 detects a waveform of residual vibration of the vibration plate when the control section 100 causes one nozzle NZ to eject the predetermined amount of the ink. Subsequently, the control section 100 analyzes the detected waveform and converts the frequency and the amplitude of the waveform into numerical values and then measures a specific vibration cycle of the waveform, and detects, based on, for example, comparison of the measured specific vibration cycles and a standard waveform at the time when an ejection failure does not occur, whether an ejection failure occurs in the nozzle NZ.

A method of the nozzle check operation is not limited to the method explained above and may be any method. The method of the nozzle check operation may be, for example, a method explained below. The control section 100 causes the nozzle NZ to eject the ink charged by a predetermined method onto a conductive material. The control section 100 detects a change in a state of an electric current in the conductive material involved in arrival of the ink on the conductive material and detects, based on a form of the change in the state of the electric current, whether an ejection failure occurs in the nozzle NZ.

The cleaning operation is operation for, in order to prevent an ejection failure from occurring because the viscosity of the ink stored in the cavities of the nozzles NZ of the inkjet head 172 increases as time elapses, forcibly sucking the ink stored in the cavities of the nozzles NZ.

The control section 100 executes the cleaning operation using a suction device that sucks the ink. The suction device is provided in a predetermined place in the printing device 1. The suction device includes, for example, a head housing section that houses the inkjet head 172, a waste ink tank that stores waste ink, a tube that couples the head housing section and the waste ink tank, and a pump that is housed in the head housing section and sucks the ink from the inkjet heat 172.

In the cleaning operation, the control section 100 moves the inkjet head 172 to the suction device and houses the inkjet head 172 in the head housing section. Subsequently, the control section 100 drives the pump. Air is sucked from the head housing section according to the driving of the pump. A negative pressure is applied to the nozzles NZ of the inkjet head 172. The ink stored in the cavities of the nozzles NZ is forcibly sucked from the nozzles NZ and stored in the waste ink tank as the waste ink.

The control section 100 executes the cleaning operation, for example, when a predetermined period elapses from the last cleaning operation or when the number of nozzles in which ejection failures are detected in the nozzle check operation is larger than a predetermined threshold. Consequently, the control section 100 can solve the ejection failures of the nozzles NZ of the inkjet head 172 and can prevent printing quality from being deteriorated.

Heating Temperature Stabilization Standby Operation

The heating temperature stabilization standby operation is explained.

The heating temperature stabilization standby operation is an operation for putting printing on the conveyed roll paper RH and conveyance of the conveyed roll paper RH on standby in a period until a heating temperature of the heater 192 stabilizes at a predetermined target temperature from a start of the driving of the heater 192.

In the heating temperature stabilization standby operation, the control section 100 puts printing on the conveyed roll paper RH and conveyance of the conveyed roll paper RH on standby until a predetermined period elapses from the start of the driving of the heater 192. The predetermined period is appropriately decided by a prior test, a simulation, or the like to be a period until the heating temperature of the heater 192 stabilizes at the predetermined target temperature.

The control section 100 is configured to be capable of detecting temperature of the heater 192 or may be configured to put printing on the conveyed roll paper RH and conveyance of the conveyed roll paper RH on standby until the heating temperature of the heater 192 continuously maintains the predetermined target temperature for a predetermined period.

Since the control section 100 executes the heating temperature stabilization standby operation, the heating unit 19 can heat the conveyed roll paper RH at a stable temperature. Therefore, when issuing the print IB with the printing section 104, the control section 100 can uniformly heat the entire region of the printed image G at a stable temperature and can prevent printing quality from being deteriorated. In particular, when continuously printing a plurality of the same images G and issuing a plurality of prints IB, the control section 100 can prevent a fixing degree of the ink from varying depending on the print IB. Therefore, when continuously printing a plurality of the same images G and issuing a plurality of prints IB, the control section 100 can prevent printing quality from varying for each of the prints IB.

Paper Feeding Operation

The paper feeding operation is explained.

The paper feeding operation is operation for, when printing is started, conveying the conveyed roll paper RH to an ejection possible region where the inkjet head 172 is capable of ejecting the ink.

When not continuously issuing the print IB, the control section 100 controls the conveying section 105 to convey the conveyed roll paper RH in the opposite direction of the conveying direction H such that a printing surface IM of the conveyed roll paper RH is not located at least in the ejection possible region of the inkjet head 172. Consequently, during printing is not executed, the control section 100 can prevent a roller trace of the conveying roller pair 155 from being formed on the printing surface IM of the conveyed roll paper RH by at least holding by the conveying roller pair 155.

When starting printing, the control section 100 conveys the conveyed roll paper RH in the conveying direction H with the paper feeding operation to convey the conveyed roll paper RH to the ejection possible region of the inkjet head 172.

Micro-Weave Printing Operation

The micro-weave printing operation is explained.

The micro-weave printing operation is a printing operation for performing printing in a micro-weave printing scheme. The micro-weave printing scheme is a printing scheme capable of performing high-resolution printing by preventing an interval of raster line dot rows adjacent to each other in the conveying direction H from depending on an interval of the nozzles NZ adjacent to each other in the conveying direction H. The raster line dot rows are dot rows arranged in a row in the crossing direction KY formed according to raster lines.

Figure 3:
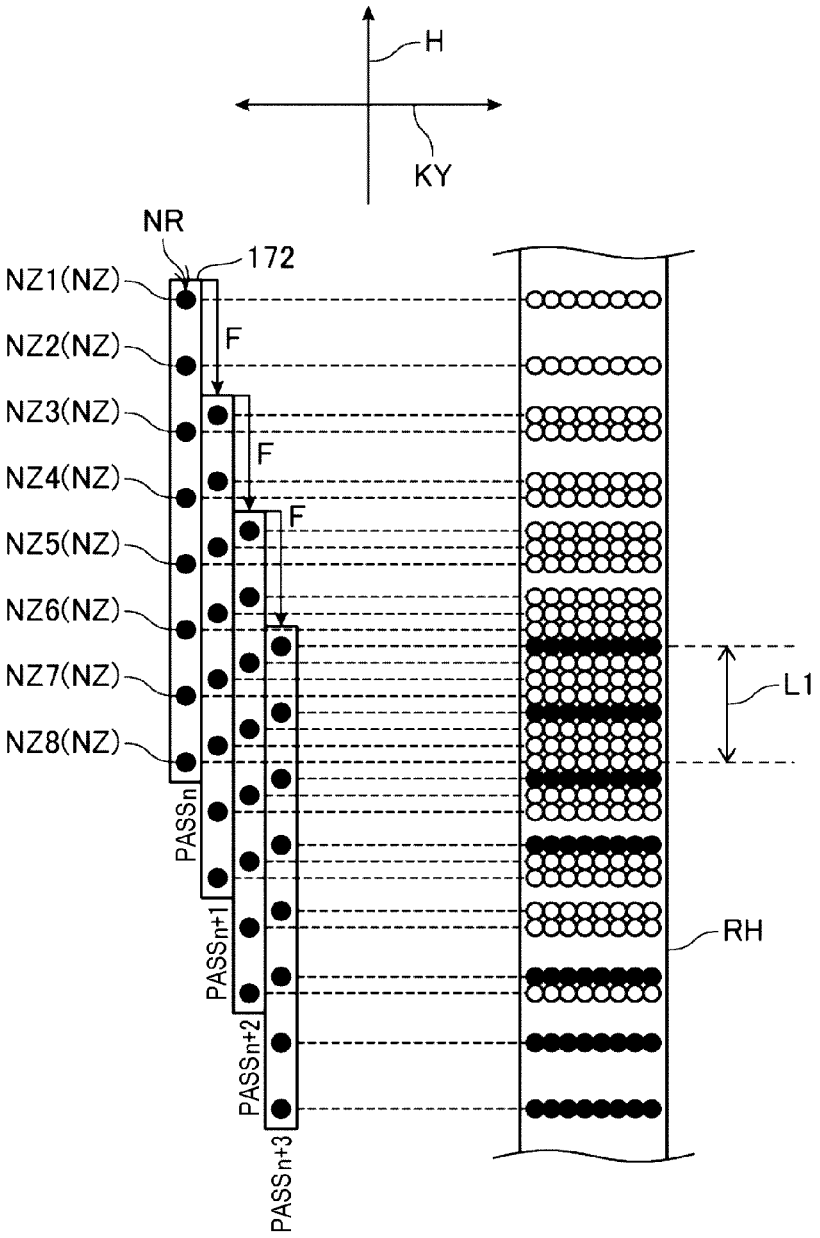
FIG. 3 is a diagram for explaining a micro-weave printing operation.

FIG. 3 is a diagram for explaining the micro-weave printing operation.

In the explanation referring to FIG. 3, as an example, the image G having length L1 in the conveying direction H is printed in four passes in the micro-weave printing operation. In FIG. 3, positions of the carriage 171 in a pass n to a pass n+3 and a state of formation of dots are shown. The pass n indicates a pass in an n-th time. "n" is any natural number. The pass indicates one movement of the carriage 171 in the crossing direction KY.

For convenience of explanation, in FIG. 3, one nozzle row NR among a plurality of nozzle rows NR is shown. For convenience of explanation, in FIG. 3, it is assumed that the nozzle rows NR include nozzles NZ1, NZ2, NZ3, NZ4, NZ5, NZ6, NZ7, and NZ8.

In FIG. 3, the nozzle row NR is shown as moving with respect to the conveyed roll paper RH. However, FIG. 3 is a diagram showing relative positions of the carriage 171 and the conveyed roll paper RH. Actually, the conveyed roll paper RH is moving in the conveying direction H. In FIG. 3, only several dots are shown as being formed. However, actually, since the ink is intermittently ejected from the nozzles NZ moving in the crossing direction KY, a large number of dots are formed in the crossing direction KY. In FIG. 3, black dots indicate dots formed by the last pass and white dots indicate dots formed by the passes other than the last pass.

In the micro-weave printing operation, every time the conveyed roll paper RH is conveyed at a fixed conveyance amount F in the conveying direction H, the nozzles NZ print raster lines right above raster lines printed in the immediately preceding pass, that is, on the downstream of the conveying direction H. For example, in the micro-weave printing operation, the ink is ejected from the nozzles NZ7 and NZ8 in the pass n to print raster lines, the ink is ejected from the nozzles NZ5 and NZ6 in the pass n+1 to print raster lines on the downstream in the conveying direction H of the raster lines printed by the nozzles NZ7 and NZ8, the ink is ejected from the nozzles NZ3 and NZ4 in the pass n+2 to print raster lines on the downstream in the conveying direction H of the raster lines printed by the nozzles NZ5 and NZ6, and the ink is ejected from the nozzles NZ1 and NZ2 in the pass n+3 to print raster lines on the downstream in the conveying direction H of the raster lines printed by the nozzles NZ3 and NZ4. Consequently, the image G having the length L1, which is a quarter of a nozzle length, is printed on the roll paper in the conveying direction H. The head length is a separation distance from the nozzle NZ located most upstream in the conveying direction H to the nozzle NZ located most downstream in the conveying direction H in the nozzle row NR.

The conveyance amount F is changed according to the resolution of the image G printed on the conveyed roll paper RH. In general, when the printing device 1 reduces the resolution and executes printing at high speed, the conveyance amount F increases according to the speed of the printing. When the printing device 1 increases the resolution and executes the printing at low speed, the conveyance amount F is small compared with when the printing device 1 executes the printing at high speed. That is, the conveyance amount F at the time when a region in the conveying direction H equivalent to a head length is filled with the number of passes is a value obtained by dividing the head length by the number of passes. Therefore, the number of passes increases when the printing is executed at high resolution.

The control section 100 can print the image G at high resolution and improve printing quality by executing the micro-weave printing operation.

Cutting Operation

The cutting operation is explained.

The cutting operation is operation related to cutting of the conveyed roll paper RH by the cutter 20. The cutting operation includes a leading end cutting operation and a trailing end cutting operation. The leading end cutting operation is operation for, when the print IB is issued, cutting an end portion TB on the downstream in the conveying direction H among end portions TB of the image G printed on the conveyed roll paper RH. In the following explanation, the end portion TB on the downstream in the conveying direction H among the end portions TB of the image G printed on the conveyed roll paper RH is referred to as downstream-side image end portion and is denoted by a reference sign "KGT". The trailing end cutting operation is operation for, when the print IB is issued, cutting the end portion TB on the upstream in the conveying direction H among the end portions TB of the image G printed on the conveyed roll paper RH. In the following explanation, the end portion TB on the upstream in the conveying direction H among the end portions TB of the image G printed on the conveyed roll paper RH is referred to as upstream-side image end portion and is denoted by a reference sign "JKT".

Figure 4:
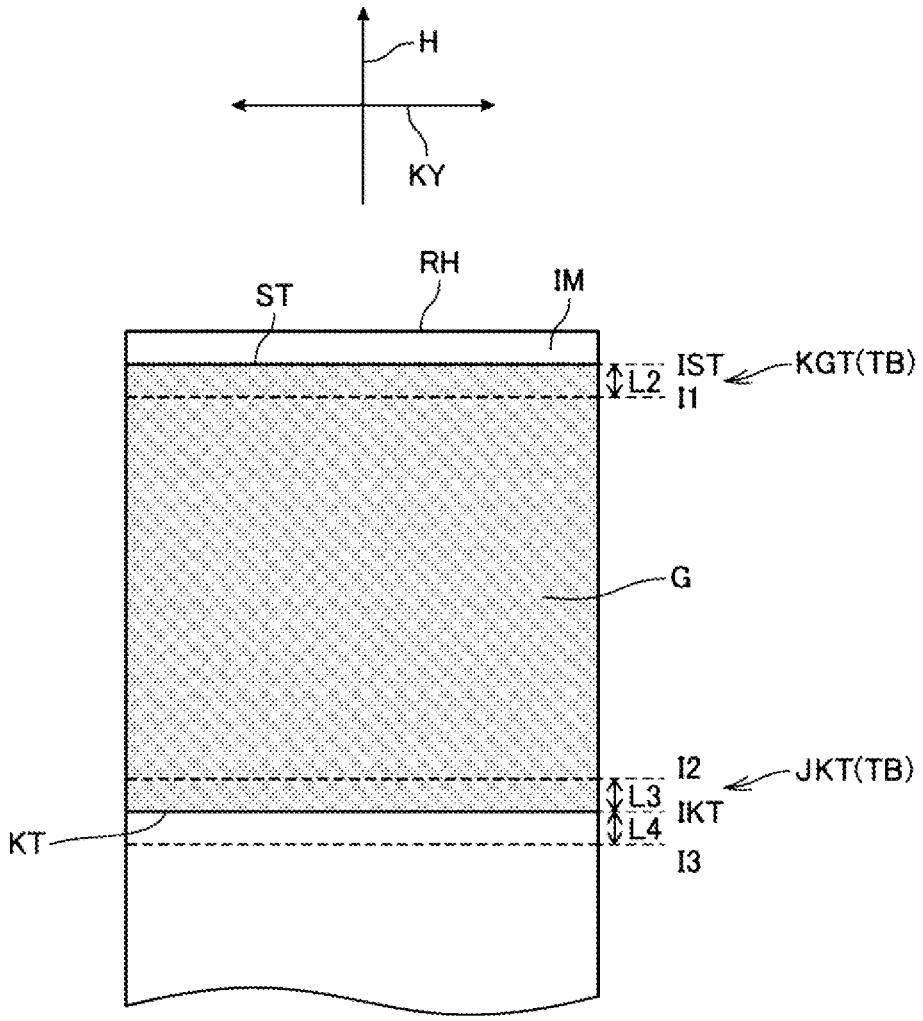
FIG. 4 is a diagram for explaining a leading end cutting operation and a trailing end cutting operation.

FIG. 4 is a diagram for explaining the leading end cutting operation and the trailing end cutting operation. In the explanation referring to FIG. 4, as an example, the marginless-printed print IB is issued. The marginless-printed print IB is the print IB, on the entire region of the printing surface IM of which the image G is printed.

When printing the image G on the conveyed roll paper RH while conveying the conveyed roll paper RH in the conveying direction H, the control section 100 executes the leading end cutting operation when a position I1 on the printing surface IM of the conveyed roll paper RH reaches a cutting position of the cutter 20 in the conveying path 14. The position I1 is a position on the printing surface IM apart by a distance L2 to the upstream in the conveying direction H from a position IST on the printing surface IM corresponding to a leading end ST of the image G. The leading end ST of the image G is an end on the downstream in the conveying direction H among ends of the image G. The distance L2 is appropriately decided in advance such that the position I1 is a position on the image G. The control section 100 decelerates the conveyance of the conveyed roll paper RH by the conveying section 105 when the position I1 on the printing surface IM reaches the cutting position of the cutter 20 in the conveying path 14 according to the conveyance of the conveyed roll paper RH. The control section 100 controls the printing section 104, drives the cutter 20, and cuts the conveyed roll paper RH in the position I1 on the printing surface IM.

After executing the leading end cutting operation, the control section 100 resumes the conveyance of the conveyed roll paper RH by the conveying section 105 and the printing of the image G by the printing section 104. After executing the leading end cutting operation, the control section 100 performs the conveyance of the conveyed roll paper RH in the conveying direction H and the printing of the image G on the conveyed roll paper RH. The control section 100 executes the trailing end cutting operation when a position I2 on the printing surface IM of the conveyed roll paper RH reaches the cutting position of the cutter 20 in the conveying path 14. The position I2 is a position on the printing surface IM apart by a distance L3 to the downstream in the conveying direction H from a position IKT on the printing surface IM corresponding to a trailing end KT of the image G. The trailing end KT of the image G is an end on the upstream in the conveying direction H among the ends of the image G. The distance L3 is appropriately decided in advance such that the position I2 is a position on the image G. The control section 100 decelerates the conveyance of the conveyed roll paper RH by the conveying section 105 when the position I2 reaches the cutting position of the cutter 20 in the conveying path 14. The control section 100 cuts the conveyed roll paper RH in the position I2 on the printing surface IM with the cutter 20.

Subsequently, the control section 100 resumes the conveyance of the conveyed roll paper RH by the conveying section 105 and conveys the conveyed roll paper RH until a position I3 on the printing surface IM reaches the cutting position of the cutter 20 in the conveying path 14. The position I3 is a position on the printing surface IM apart by a distance L4 to the upstream in the conveying direction H from the position IKT. The distance L4 is appropriately decided in advance such that the position I3 is not a position on the image G. The control section 100 decelerates the conveyance of the conveyed roll paper RH by the conveying section 105 when the position I3 on the printing surface IM reaches the cutting position of the cutter 20 in the conveying path 14. The control section 100 cuts the conveyed roll paper RH in the position I3 in the conveyed roll paper RH with the cutter 20.

The control section 100 can issue the marginless-printed print IB by executing the leading end cutting operation and the trailing end cutting operation in this way.

When not issuing the marginless-printed print IB, in the cutting operation, the control section 100 does not execute the leading end cutting operation or executes the leading end cutting operation in a predetermined position further on the downstream in the conveying direction H than the leading end ST of the image G. When not issuing the marginless-printed print IB, the control section 100 executes the trailing end cutting operation in the cutting operation but performs only the cutting in the position I3 without performing the cutting in the position I2. Consequently, the control section 100 can issue the print IB having margins in both directions of the conveying direction H of the image G. In the following explanation, the print IB having margins in both the directions of the conveying direction H of the image G is referred to as "margin-printed print IB".

The operation of the printing device 1 in performing the first print in the normal printing mode is explained.

The control section 100 determines whether printing request data is received from the host device 2 by the communication section 101. The printing request data is data including image data indicating the image G printed on the conveyed roll paper RH and the number of issued prints IB on which the image G indicated by the image data is printed.

When receiving the printing request data IYD, the control section 100 starts, based on image data included in the printing request data IYD, generation of printing data for each print IB to be issued. The printing data is data obtained by applying processing such as resolution conversion processing, color conversion processing, halftone processing, rasterize processing, and command addition processing to the image data. In the generation of the printing data, the control section 100 appropriately sets, in pass units, ejection timing for ejecting the ink and the nozzles NZ in use to execute the micro-weave printing operation at the number of passes corresponding to resolution designated by the user or preset resolution.

In the following explanation, the printing data related to the print IB issued by the first print is referred to as "first-print printing data".

After generating the printing data, the control section 100 executes the maintenance operation. In the maintenance operation, the control section 100 executes the nozzle check operation and executes the cleaning operation when the number of nozzles in which ejection failures are detected exceeds a predetermined number.

After executing the nozzle check operation or the nozzle check operation and the cleaning operation, the control section 100 executes the paper feeding operation and conveys the printing surface IM of the conveyed roll paper RH to the ejection possible region of the inkjet head 172. Subsequently, the control section 100 executes the heating temperature stabilization standby operation and, after the execution of the heating temperature stabilization standby operation, starts printing based on the generated printing data.

In the printing based on the printing data, the control section 100 executes the cutting operation while executing the micro-weave printing operation. When issuing the marginless-printed print IB, the control section 100 executes the cutting operation explained with reference to FIG. 4.

The high-speed printing mode is explained with reference to FIG. 5.

The high-speed printing mode is an operation mode for, when performing the first print, executing a change for omitting, according to operation, a part of a plurality of operations executed in the normal printing mode or simplifying operation content.

Figure 5:
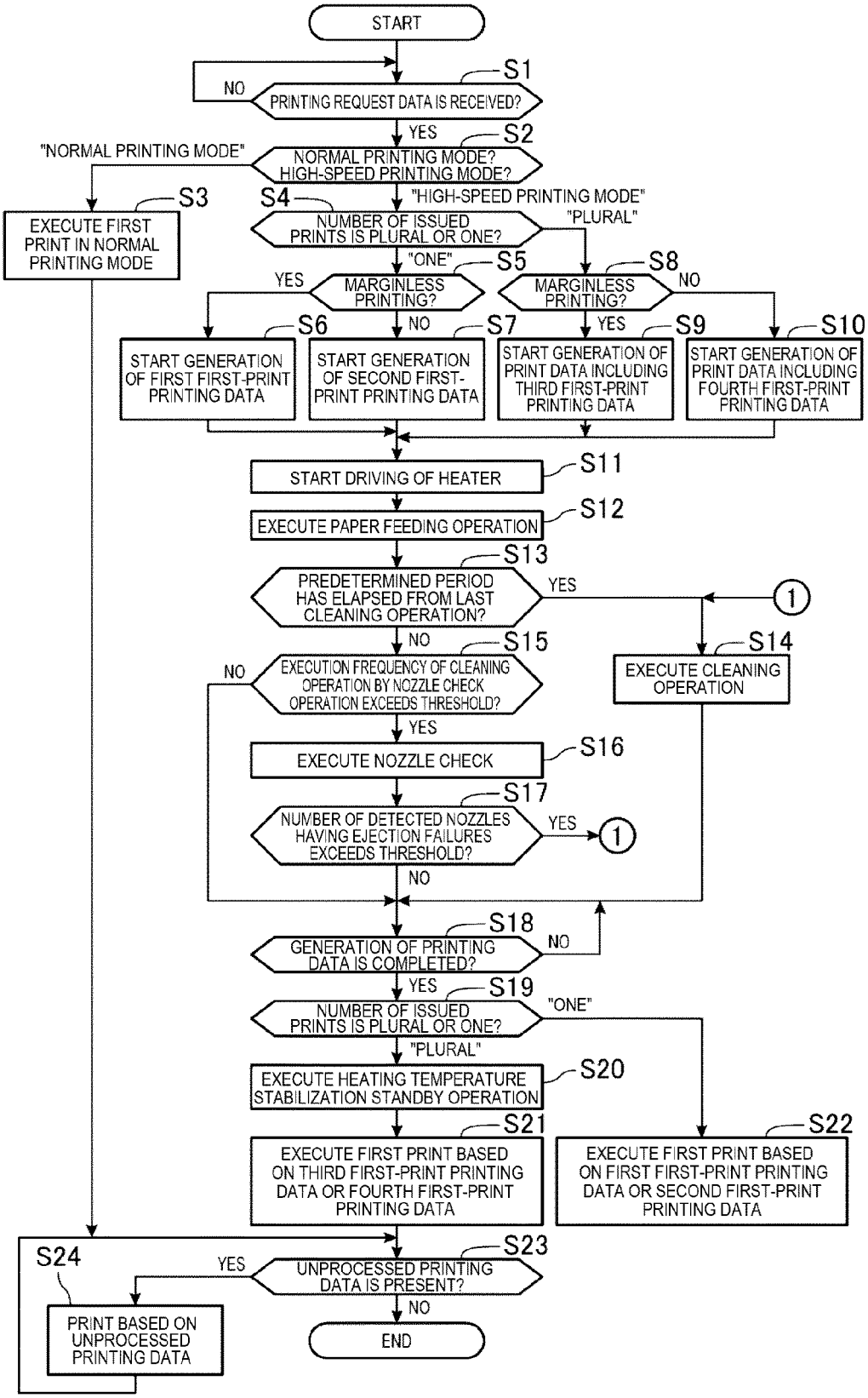
FIG. 5 is a flowchart showing the operation of the printing device.

FIG. 5 is a flowchart showing the operation of the printing device 1.

The control section 100 of the printing device 1 determines whether the printing request data IYD is received from the host device 2 via the communication section 101 (step S1). When determining that the printing request data IYD is not received (NO in step S1), the control section 100 returns the processing to step S1.

On the other hand, when determining that the printing request data IYD is received from the host device 2 (YES in step S1), the control section 100 determines whether the operation mode in performing the first print is set to the normal printing mode or set to the high-speed printing mode (step S2). The operation mode is set by the user in advance. Setting content is stored in the setting data 122 as setting values.

When determining that the operation mode is set to the normal printing mode ("normal printing mode" in step S2), the control section 100 performs the first print in the normal printing mode (step S3). That is, the control section 100 executes the first print without omitting the maintenance operation, the heating temperature stabilization standby operation, the paper feeding operation, the micro-weave printing operation, and the cutting operation and changing operation content.

On the other hand, when determining that the operation mode is set to the high-speed printing mode ("high-speed printing mode" in step S2), the control section 100 determines whether the number of issued prints IB included in the printing request data IYD received from the host device 2 is plural or one (step S4).

When determining that the number of issued prints IB is one ("1" in step S4), the control section 100 determines whether to issue the marginless-printed print IB (step S5).

For example, when data indicating that the marginless-printed print IB is issued is stored in the setting data 122 as a setting value, the control section 100 affirmatively determines in step S5. When the data indicating that the marginless-printed print IB is issued is included in the printing request data IYD received from the host device 2, the control section 100 affirmatively determines in step S5.

When determining to issue the marginless-printed print IB (YES in step S5), the control section 100 starts generation of first first-print printing data (step S6). The first first-print printing data is first-print printing data generated when the number of issued marginless-printed prints IB is one. The first first-print printing data is explained in detail below.

On the other hand, when determining not to issue the marginless-printed print IB (NO in step S5), the control section 100 generates second first-print printing data (step S7). The second first-print printing data is first-print printing data generated when the number of margin-printed prints IB is one. The second first-print printing data is explained in detail below.

Returning to the explanation of step S4, when determining that the number of issued prints IB is plural ("plural" in step S4), the control section 100 determines whether to issue the marginless-printed print IB (step S8).

When determining to issue the marginless-printed print IB (YES in step S8), the control section 100 starts generation of printing data including third first-print printing data (step S9). The third first-print printing data is first-print printing data generated when the number of issued marginless-printed prints IB is plural. The third first-print printing data is explained in detail below.

On the other hand, when determining not to issue the marginless-printed print IB (NO in step S8), the control section 100 generates printing data including fourth first-print printing data (step S10). The fourth first-print printing data is first-print printing data generated when the number of issued margin-printed prints IB is plural. The fourth first-print printing data is explained in detail below.

After starting the generation of the first-print printing data, the control section 100 controls the heating unit 19 of the printing section 104 and starts driving of the heater 192 (step S11).

Subsequently, the control section 100 controls the conveying section 105 and executes the paper feeding operation (step S12).

In this way, in the high-speed printing mode, the control section 100 differentiates timing for executing the paper feeding operation from timing for executing the paper feeding operation in the normal printing mode. That is, in the high-speed printing mode, rather than executing the paper feeding operation after generation of the printing data including the first-print printing data is completed, the control section 100 executes the paper feeding operation after the generation of the printing data is started. Consequently, in the high-speed printing mode, when the generation of the printing data including the first-print printing data is completed and the first print is started based on the printing data, it is unnecessary to execute the paper feeding operation. Accordingly, in the high-speed printing mode, compared with the normal printing mode, it is possible to quickly start the first print. Therefore, the printing device 1 can perform the first print at high speed.

The printing device 1 may execute the processing in the order of steps S11 and S12.

Subsequently, after executing the paper feeding operation, the control section 100 determines whether a predetermined period has elapsed from the last cleaning operation (step S13). When determining that the predetermined period has elapsed from the last cleaning operation (YES in step S13), the control section 100 executes the cleaning operation (step S14).

On the other hand, when determining that the predetermined period has not elapsed from the last cleaning operation (NO in step S14), the control section 100 determines whether an execution frequency of the cleaning operation by the nozzle check operation exceeds a predetermined threshold (step S15).

For example, the storing section 120 has stored therein the number of times of the nozzle check operation executed in a certain period and the number of times of the cleaning operation executed according to a detection result of the nozzle check operation in the certain period. The control section 100 calculates, based on these numbers of times, an execution frequency of the cleaning operation by the nozzle check operation and determines whether the execution frequency exceeds a predetermined threshold.

When determining that the execution frequency of the cleaning operation by the nozzle check operation exceeds the predetermined threshold (YES in step S15), the control section 100 executes the nozzle check operation (step S16).

The control section 100 determines whether the number of nozzles NZ having the ejection failures detected in the nozzle check operation in step S16 exceeds a predetermined threshold (step S17). When determining that the detected number of nozzles NZ having the ejection failures exceeds the predetermined threshold (YES in step S17), the control section 100 shifts the processing to step S14 and executes the cleaning operation. On the other hand, when determining that the number of nozzles NZ having the ejection failures does not exceed the predetermined threshold (NO in step S17), the control section 100 executes processing in step S18.

Returning to the explanation of step S15, when determining that the execution frequency of the cleaning operation by the nozzle check operation does not exceed the predetermined threshold (NO in step S15), the control section 100 executes the processing in step S18 without executing the processing in steps S16 and S17. That is, the control section 100 omits the nozzle check operation.

In this way, the control section 100 omits the maintenance operation in the high-speed printing mode. More in detail, when negatively determining in steps S13 and S15, the control section 100 omits the nozzle check operation. When the nozzle check operation is omitted, the cleaning operation is also omitted. Therefore, when negatively determining in steps S13 and S15, the control section 100 omits the maintenance operation. In this way, when performing the first print, by omitting the nozzle check operation and the cleaning operation, the first print can be more quickly started by at least a time required for the nozzle check operation compared with the normal operation mode. Therefore, the printing device 1 can perform the first print at high speed.

In step S18, the control section 100 determines whether the generation of the printing data including the first-print printing data is completed. When determining that the generation of the printing data is not completed (NO in step S18), the control section 100 executes the processing in step S18 again. On the other hand, when determining that the generation of the printing data including the first-print printing data is completed (YES in step S18), the control section 100 determines whether the number of issued prints IB indicated by the printing request data IYD is plural or one (step S19).

When determining that the number of issued prints IB is plural (YES in step S19), the control section 100 executes the heating temperature stabilization standby operation (step S20). After executing the heating temperature stabilization standby operation, the control section 100 executes the first print based on the third first-print printing data or the fourth first-print printing data (step S21).

As explained above, the third first-print printing data is the first-print printing data generated when the number of issued marginless-printed prints IB is plural. The third first-print printing data is first-print printing data generated by omitting the micro-weave printing operation for the end portion TB of the image G in the conveying direction H. More in detail, the third first-print printing data is first-print printing data generated by omitting the micro-weave printing operation concerning the printing of the upstream-side image end portion JKT and the downstream-side image end portion KGT cut off from the finally issued print IB in the leading end cutting operation and the trailing end cutting operation.

For example, referring to FIG. 4, when the upstream-side image end portion JKT cut off from the finally issued print IB is a region from the trailing end KT of the image G to the position I2, the control section 100 generates, concerning printing of the region, the third first-print printing data indicating that the region is printed in one time of a pass. Referring to FIG. 4, when the downstream-side image end portion KGT cut off from the finally issued print IB is a region from the leading end ST of the image G to the position I1, the control section 100 generates, concerning printing of the region, the third first-print printing data indicating that the region is printed in one time of a pass.

When executing the first print based on the third first-print printing data in step S21, the control section 100 omits, during the first print, the micro-weave printing operation for the end portion TB of the image G in the conveying direction H. As explained above, since the printing device 1 does not print the end portion TB of the image G in a plurality of passes, the printing device 1 can quickly print the image G compare with when the entire image G is printed by the micro-weave printing operation. Therefore, the printing device 1 can perform the first print at high speed. The end portion TB of the image G for which the micro-weave printing operation is omitted is cut by the cutting operation and is cut off from the print IB to be issued. Therefore, even if the micro-weave printing operation is omitted for the end portion TB of the image G, the printing quality of the finally issued print IB is not deteriorated. Consequently, the printing device 1 can perform the first print at high speed while preventing deterioration in the printing quality of the marginless-printed print IB.

The third first-print printing data is first-print printing data indicating that only the position I2 of the printing surface IM is cut by the cutter 20 in the trailing end cutting operation.

When executing the first print based on the third first print printing data in step S21, the control section 100 does not perform, during the first print, the cutting by the cutter 20 twice in the trailing end cutting operation. That is, in the high-speed printing mode, the control section 100 changes the cutting operation such that the number of times of cutting of the cutter 20 in the cutting operation is smaller than the number of times of cutting in the normal printing mode. Consequently, in the high-speed printing mode, the control section 100 can reduce a time required for the first print by a time required for one cutting compared with the normal printing mode. Therefore, the control section 100 can perform the first print at high speed.

In particular, during the first print based on the third first-print printing data, the control section 100 performs cutting in the position I2 and does not perform cutting in the position I3 in the trailing end cutting operation. That is, in the high-speed printing mode, the control section 100 does not cut the further opposite direction side of the conveying direction H than the trailing end KT of the image G during the first print related to the marginless-printed print IB. This is because, since the leading end cutting operation is executed next time during issuance of the marginless-printed print IB, even if the conveyed roll paper RH in the position I2 to the position I3 remains at a start time of the next print IB issuance, this does not affect the printing quality of the marginless-printed print IB issued next time. Therefore, when issuing a plurality of marginless-printed prints IB, the printing device 1 can perform the first print at high speed without affecting the printing quality of the print IB to be issued.

As explained above, the fourth first-print printing data is first-print printing data generated when the number of issued margin-printed prints IB is plural. The fourth first-print printing data is first-print printing data generated by not omitting the micro-weave printing operation for the end portion TB of the image G compared with the third first-print printing data. The fourth first-print printing data is first-print printing data indicating that the leading end cutting operation is not executed in the cutting operation and only the position I3 is cut by the cutter 20 in the trailing end cutting operation.

After executing the first print based on the fourth first-print printing data in step S21, the control section 100 issues the margin-printed print IB. In the high-speed printing mode, the control section 100 changes execution timing of the paper feeding operation and omits the maintenance operation when negatively determining in steps S13 and S15. Therefore, the control section 100 can perform the first print related to the margin-printed print IB at high speed.

As explained above, even in the high-speed printing mode, the control section 100 executes the heating temperature stabilization standby operation when continuously printing the same image G and issuing a plurality of prints IB. Consequently, the heating unit 19 can heat the conveyed roll paper RH at a stable temperature. Therefore, when continuously printing the same image G and issuing a plurality of prints IB, the control section 100 can prevent a degree of drying and fixing of the ink from varying depending on the prints IB. Therefore, when continuously printing the same image G and issuing a plurality of prints IB, the printing device 1 can prevent printing quality from varying for each of the prints IB.

Returning to the explanation of step S19, when determining that the number of issued prints IB is one (NO in step S19), the control section 100 executes the first print based on the first first-print printing data or the second first-print printing data (step S22). That is, the control section 100 omits the heating temperature stabilization standby operation and executes the first print.

In this way, in the high-speed printing mode, the control section 100 omits the heating temperature stabilization standby operation when not continuously printing the image G, that is, when issuing one print IB. When one print IB is issued, it is less probable that the user who causes the printing device 1 to issue the print IB picks up a plurality of prints IB on which the same image G is printed and compares the prints IB. Therefore, when the number of issued prints IB is one, even if the heating temperature of the heater 192 does not stabilize at the predetermined target temperature, if the ink is fixed on the conveyed roll paper RH, it is highly probable that sufficient quality can be secured as the printing quality of the print IB acquired by the user. Therefore, as explained above, in the high-speed printing mode, when issuing one print IB, the control section 100 omits the heating temperature stabilization standby operation. Consequently, the control section 100 can more quickly start the first print by a time required for the heating temperature stabilization standby operation. Therefore, the control section 100 can perform the first print at high speed.

As explained above, the first first-print printing data is the first-print printing data generated when the number of issued marginless-printed prints IB is one. The first first-print printing data is first-print printing data that is the same as the third first-print printing data concerning the micro-weave printing operation and the number of times of cutting in the cutting operation. When compared with the third first-print printing data, the first first-print printing data is different in a conveyance form of the conveying section 105 in the cutting operation. That is, in the cutting operation, the first first-print printing data is first-print printing data indicating that the cutting by the cutter 20 is executed without decelerating the conveyance of the conveying section 105.

In the first print based on the first first-print printing data in step S22, the control section 100 omits the micro-weave printing operation for the end portion TB of the image G in the conveying direction H. Consequently, the same effects as the effects explained above are achieved. In the first print based on the first first-print printing data, the control section 100 executes the cutting in the position I2 and does not execute the cutting in the position I3 in the trailing end cutting operation. Consequently, the same effects as the effects explained above are achieved.

In the first print based on the first first-print printing data, the control section 100 executes the cutting by the cutter 20 without decelerating the conveyance of the conveying section 105. When the same image G is not continuously printed, that is, when one print IB is issued, it is less probable that the user who issues the print IB with the printing device 1 picks up a plurality of prints IB on which the same image G is printed and compares the prints IB. Therefore, even if the cutting cannot be highly accurately performed in the position I1 and the position I2, if the finally issued print IB is the marginless-printed print IB, it is highly probable that sufficient quality can be secured as the printing quality of the print IB acquired by the user. Therefore, as explained above, in the high-speed printing mode, when issuing one print IB without continuously printing the image G, the control section 100 executes the cutting operation without decelerating the conveyance of the conveying section 105. Consequently, the control section 100 can reduce a time required for the first print because the conveyance of the conveying section 105 is not decelerated. Therefore, the control section 100 can perform the first print at high speed.

As explained above, the second first-print printing data is the first-print printing data generated when the number of issued margin-printed prints IG is one. The second first-print printing data is the same first-print printing data as the fourth first-print printing data concerning the micro-weave printing operation and the number of times of cutting and the cutting position in the cutting operation. Therefore, after executing the first print based on the second first-print printing data, the control section 100 issues the margin-printed print IB.

Compared with the fourth first-print printing data, the second first-print printing data is different in a conveyance form of the conveying section 105 in the cutting operation. That is, the second first-print printing data is first-print printing data indicating that the cutting by the cutter 20 is executed without decelerating the conveyance of the conveying section 105 in the cutting operation.

The control section 100 executes the cutting by the cutter 20 without decelerating the conveyance of the conveying section 105 in the first print based on the second first-print printing data. Consequently, even when one marginless-printed print IB is issued, the same effects as the effects of the first print based on the first first-print printing data are achieved.

Referring to the flowchart of FIG. 5, the control section 100 determines whether unprocessed printing data is present other than the first-print printing data (step S23). When determining that unprocessed printing data is present other than the first-print printing data (YES in step S23), the control section 100 executes printing based on the unprocessed printing data (step S24). On the other hand, when determining that unprocessed printing data is absent other than the first-print printing data (NO in step S23), the control section 100 ends the processing.

As explained above, the printing device 1 includes the printing section 104 including the inkjet head 172 that ejects the ink onto the conveyed roll paper RH, the conveying section 105 that conveys the conveyed roll paper RH, and the control section 100 that prints the image G on the conveyed roll paper RH with the printing section 104 and the conveying section 105. The control section 100 has the normal printing mode for printing the image G with a plurality of operations based on the printing section 104 and the conveying section 105 and the high-speed printing mode for, during the first print, printing the image G while omitting or changing a part of the plurality of operations included in the normal printing mode according to the operation.

With this configuration, in the high-speed printing mode, the image G is printed while omitting or changing a part of the plurality of operations executed in the normal printing mode according to the operation. Therefore, a time required for the first print can be reduced. Therefore, the printing device 1 can perform the first print at high speed.

The plurality of operations executed in the normal printing mode include the maintenance operation for maintaining the inkjet head 172. The control section 100 omits the maintenance operation in the high-speed printing mode.

With the configuration, when the first print is performed, the first print can be more quickly started by at least a time required for the nozzle check operation compared with the normal printing mode by omitting the maintenance operation. Therefore, the printing device 1 can perform the first print at high speed.

The plurality of operations executed in the normal printing mode include the micro-weave printing operation. In the high-speed printing mode, the control section 100 omits the micro-weave printing operation for the end portion TB of the image G in the conveying direction H of the conveyed roll paper RH.

With this configuration, since the end portion TB of the image G is not printed in a plurality of passes, printing of the image G can be quickly performed. Therefore, the control section 100 can perform the first print at high speed. The end portion TB of the image G for which the micro-weave printing operation is omitted is cut by the cutting operation and cut off from the print IB to be issued. Therefore, the control section 100 can issue the print IB, the printing quality of which is not deteriorated. Consequently, the printing device 1 can perform the first print at high speed while preventing deterioration in the printing quality.

The printing section 104 includes the cutter 20 that cuts the conveyed roll paper RH. The plurality of operations in the normal printing mode include the cutting operation for cutting the conveyed roll paper RH with the cutter 20. In the high-speed printing mode, the control section 100 changes the cutting operation such that the number of times of cutting in the cutting operation is smaller than the number of times of cutting during the normal printing mode.

With this configuration, in the high-speed printing mode, the control section 100 can reduce a time required for the first print by at least a time required for the cutting corresponding to the reduced number of times of cutting compared with normal printing mode. Therefore, the printing device 1 can perform the first print at high speed.

The control section 100 changes the number of times of cutting at the end portion TB on the upstream in the conveying direction H of the conveyed roll paper RH among the end portions TB of the image G.

With this configuration, when the leading end cutting operation is executed during the next printing, the printing quality of the next print IB is not affected. Therefore, even when issuing a plurality of prints IB, the printing device 1 can perform first print at high speed without affecting the printing quality of the prints IB.

The printing section 104 includes the cutter 20 that cuts the conveyed roll paper RH. The plurality of operations in the normal printing mode include the cutting operation for cutting the conveyed roll paper RH with the cutter 20. When not continuously printing a plurality of images G in the high-speed printing mode, the control section 100 changes the cutting operation to cut the conveyed roll paper RH without decelerating the conveyance of the conveyed roll paper RH in the cutting operation.

With this configuration, since the control section 100 does not decelerate the conveyance of the conveying section 105, the control section 100 can reduce a time required for the first print. Therefore, the printing device 1 can perform the first print at high speed.

The printing section 104 includes the heating unit 19 that heats the conveyed roll paper RH. The plurality of operations in the normal printing mode include the standby operation for putting printing of the image G on standby until the heating temperature of the heating unit 19 stabilizes. When not continuously printing a plurality of images G in the high-speed printing mode, the control section 100 omits the heating temperature stabilization standby operation.

With this configuration, the control section 100 can more quickly start the first print by a time required for the heating temperature stabilization standby operation. Therefore, the printing device 1 can perform the first print at high speed.

The embodiment explained above only indicates a form of the present disclosure. Modifications and applications of the embodiment can be optionally made within the scope of the present disclosure.

For example, in the embodiment, the configuration is explained in which the maintenance operation, the microweave printing operation for the end portion TB of the image G, and the heating temperature stabilization standby operation are omitted in the high-speed printing mode. However, operations omitted in the high-speed printing mode may be a part of these operations. For example, in the embodiment explained above, the configuration is explained in which the operation contents of the paper feeding operation and the cutting operation are changed and simplified in the high-speed printing mode. However, operations, operation contents of which are changed in the high-speed printing mode, may be a part of these operations. The omitted operations and the operations, the operation contents of which are changed, may be able to be set beforehand.

The operations omitted in the high-speed printing mode or the operations, the operation contents of which are changed in the high-speed printing mode, are not limited to the maintenance operation, the heating temperature stabilization standby operation, the paper feeding operation, the microweave printing operation, and the cutting operation. For example, in the high-speed printing mode, operation content of the operation in which the inkjet head 172 ejects the ink may be changed such that printing duty is lower than the printing duty in the normal printing mode. The printing duty is a ratio of the number of dots that can be formed in a predetermined printing region and the number of dots actually formed by ejection of the ink. As the printing duty is lower, a time required for drying and fixing of the ink further decreases. Therefore, in the high-speed printing mode, the heating temperature of the heater 192 may be lower than the heating temperature in the normal printing mode. Therefore, in the case of the configuration for reducing the printing duty in the high-speed printing mode, the printing device 1 can reduce a time required for the heating temperature stabilization standby operation and can perform the first print at high speed.

For example, when a control method for the printing device 1 explained above is realized using a computer included in the printing device 1 or an external device coupled to the printing device 1, the present disclosure can also be configured in a form of a program executed by the computer in order to realize the method, a recording medium recording the program to be readable by the computer, or a transmission medium for transmitting the program.

In the example explained above, the functions of the control section 100 are realized by one processor 110. However, the functions of the control section 100 may be realized by a plurality of processors or semiconductor chips.

For example, the processing units in FIG. 5 are divided according to main processing contents in order to facilitate understanding of the processing. The present disclosure is not limited by a method of division and names of the processing units. According to processing contents, the processing units may be divided into a larger number of processing units or may be divided such that one processing unit includes a larger number of kinds of processing. The order of the processing may be changed as appropriate without hindering the gist of the present disclosure.

The functional sections shown in FIG. 2 indicate functional components. Specific implementation forms of the functional sections are not particularly limited. That is, hardware individually corresponding to the functional sections does not always need to be implemented. It is naturally possible to adopt a configuration in which one processor executes programs to realize functions of a plurality of functional sections. A part of the functions realized by software in the embodiment explained above may be realized by hardware. Alternatively, a part of the functions realized by hardware in the embodiment may be realized by software. Besides, the specific detailed configurations of the other sections of the printing device 1 can also be optionally changed without departing from the gist of the present disclosure.

What is claimed is:

1. A printing device comprising:

a printing section including a printing head configured to eject ink onto a printing medium and a heating section configured to heat the printing medium;

a conveying section configured to convey the printing medium; and a control section configured to print an image on the printing medium with the printing section and the conveying section, wherein the control section has a first printing mode for printing the image with a plurality of operations based on the printing section and the conveying section and a second printing mode for, during first printing after acquisition of a printing request, printing the image while omitting or changing a part of the plurality of operations included in the first printing mode according to the operation, the plurality of operations include a standby operation for putting printing of the image on standby until a heating temperature of the heating section stabilizes, and the control section omits the standby operation when not continuously printing a plurality of the images in the second printing mode.

2. The printing device according to claim 1, wherein the plurality of operations include a maintenance operation for maintaining the printing head, and the control section omits the maintenance operation in the second printing mode.

3. The printing device according to claim 1, wherein the plurality of operations include a micro-weave printing operation for performing printing in a micro-weave printing scheme with the printing section, and the control section omits, in the second printing mode, the micro-weave printing operation for an end portion of the image in a conveying direction of the printing medium.

4. The printing device according to claim 1, wherein the printing section includes a cutting section configured to cut the printing medium, the plurality of operations include a cutting operation for cutting the printing medium with the cutting section, and the control section changes, in the second printing mode, the cutting operation such that a number of times of cutting in the cutting operation is smaller than the number of times of cutting during the first printing mode.

5. The printing device according to claim 4, wherein the control section changes the number of times of cutting at an end portion on an upstream of the conveying direction of the printing medium among end portions of the image.

6. A printing device comprising:

a printing section including a printing head configured to eject ink onto a printing medium and a cutting section configured to cut the printing medium;

a conveying section configured to convey the printing medium; and a control section configured to print an image on the printing medium with the printing section and the conveying section, wherein the control section has a first printing mode for printing the image with a plurality of operations based on the printing section and the conveying section and a second printing mode for, during first printing after acquisition of a printing request, printing the image while omitting or changing a part of the plurality of operations included in the first printing mode according to the operation, the plurality of operations include a cutting operation for cutting the printing medium with the cutting section, and when not continuously printing a plurality of the images in the second printing mode, the control section changes the cutting operation to cut the printing medium without decelerating the conveyance of the printing medium in the cutting operation.

7. A control method for a printing device including: a printing section including a printing head configured to eject ink onto a printing medium; a conveying section configured to convey the printing medium; a heating section configured to heat the printing medium, and a control section configured to print an image on the printing medium with the printing section and the conveying section, wherein the control section prints, in a first printing mode, the image with a plurality of operations based on the printing section and the conveying section and prints, in a second printing mode, during first printing after acquisition of a printing request, the image while omitting or changing a part of the plurality of operations included in the first printing mode according to the operation, the plurality of operations include a standby operation for putting printing of the image on standby until a heating temperature of the heating section stabilizes, and the control section omits the standby operation when not continuously printing a plurality of the images in the second printing mode.

* * * * *